United States Patent [19]

Kay et al.

[11] Patent Number: 4,565,021

[45] Date of Patent: Jan. 21, 1986

[54] PORTABLE IRONING BOARD

[75] Inventors: John W. Kay, Frankfort; Dale A. Shaffer, Lebanon; Maurice H. Basquin, Lebanon, all of Ind.

[73] Assignee: Harmeson Manufacturing Company, Inc., Frankfort, Ind.

[21] Appl. No.: 637,835

[22] Filed: Aug. 6, 1984

[51] Int. Cl.[4] ..... D06F 81/02

[52] U.S. Cl. ..... 38/137; 108/19; 248/439

[58] Field of Search ..... 108/12, 19, 130, 123, 108/149; 248/155.1, 188.6, 439; 297/408; 38/DIG. 1, DIG. 2, DIG. 3, 137, 112, 103, 104

[56] References Cited

U.S. PATENT DOCUMENTS

| | | | |
|---|---|---|---|
| 982,093 | 1/1911 | Russ . | |
| 998,988 | 7/1911 | Reynolds . | |
| 1,563,236 | 11/1925 | Smith . | |
| 1,709,927 | 4/1929 | Whitney . | |
| 2,187,593 | 1/1940 | Tonn | 108/123 |
| 2,198,608 | 4/1940 | Flagstad | 108/123 |
| 2,785,936 | 3/1957 | Cvikich . | |
| 4,064,815 | 12/1977 | Baum . | |

FOREIGN PATENT DOCUMENTS

| | | | |
|---|---|---|---|
| 1151928 | 2/1958 | France | 108/12 |
| 416184 | 9/1934 | United Kingdom | 108/19 |

*Primary Examiner*—Werner H. Schroeder
*Assistant Examiner*—Andrew M. Falik
*Attorney, Agent, or Firm*—Lowe, King, Price & Becker

[57] ABSTRACT

A collapsible portable ironing board comprises a ironing board top to which first and second pairs of legs are pivotally secured. Each pair of legs is connected respectively to opposite ends of a cross rod that is journalled in brackets for attachment to the underside of the board. Each cross rod includes a crook formed intermediate opposite ends of the rod. The crook extends in a plane offset with respect to the associated legs. To set up the ironing board, the legs pivot outwardly away from the board underside until the offset portions are in flush contact with the underside. To collapse the board, the legs are pivoted into flush contact with the board underside with the crook portions disposed in a plane angularly offset from the underside. Each crook portion defines an opening with the board underside that is inclined with respect to the board so as to be engageable with a mounting hook or the like to store the ironing board on a wall between periods of use.

11 Claims, 7 Drawing Figures

PORTABLE IRONING BOARD

TECHNICAL FIELD

The present invention relates generally to table construction and, more particularly, to a portable ironing board with a leg locking mechanism for securing the legs in an extended position.

BACKGROUND ART

Ironing boards typically comprise an elongate rigid board having a flat upper surface covered with a fire retardant material. To support the ironing board in an elevated usable position, first and second pairs of tubular legs are usually employed, wherein upper ends of the first pair are pivotally attached to one end of an underside of the board while corresponding ends of the second pair are received in slide tracks longitudinally fixed to the underside. Intermediate portions of each first pair of legs are pivotally connected to corresponding portions of the second pair. By pivoting the first pair into a supportive position, the second pair automatically pivots by virtue of the pivotal connections with the first pair and sliding movement of the upper ends of the second pair through the tracks. Upon travelling through the tracks, the legs automatically lock by means of a locking tab fixed to the second pair upper ends entering a hole formed in a side wall of each track. Depressing a release lever connected to pivot each tab out of locking engagement with the tracks enables the user to collapse the legs for storage of the ironing board.

The aforesaid legs and locking mechanism provide reliable load bearing conditions when the ironing board is in use provided that the legs are of sufficient length so as to be connected together and to the board in the aforesaid manner. However, in sleeve ironing boards and in portable ironing boards commonly used by individuals while travelling, the aforesaid known construction unnecessarily increases both weight and space of the ironing board, as well as cost.

To minimize weight and space requirements, portable ironing boards generally employ shorter legs and simpler leg locking mechanisms enabling positioning of the board on an elevated support surface (e.g., desk or dresser top in a hotel room). One type of portable board is disclosed in U.S. Pat. No. 998,988 to Reynolds, wherein first and second pairs of legs have opposite ends pivotally attached to an ironing board and a support base with brackets. Lower ends of one leg pair are angled to flushly engage the base when the legs pivot to elevate the ironing board into a useable position. To lock the ironing board into the elevated position, the angled ends are held in tight fitting contact with the base by wings of a nut located between the ends, preventing pivotal movement.

While the portable board disclosed in the Reynolds patent is somewhat simpler in design than the full size board discussed supra, the presence of a large base increases the weight of the portable unit while the wing nut and bolt mechanism increase the complexity of the locking structure. To maintain the board in the elevated position by engaging the lower angled ends of the first leg pair with the wing nut requires precise orthogonal positioning of the wings with respect to the angled ends, necessitating an additional step of holding the board to lock the legs once they have been pivoted to the upright position.

It is accordingly an object of the present invention to provide a portable ironing board or table having collapsible legs that automatically lock upon pivoting into an extended position to support the board in an elevated position and unlock upon collapsing the legs against the board.

Another object of the present invention is to provide a portable ironing board or table having a locking mechanism that functions as a hook for storing the collapsed structure on a wall between periods of use.

Still another object is to provide a portable ironing board or table that is light weight and simple in design and readily collapsible to occupy a minimum of storage space.

Yet a further object of the invention is to provide a portable ironing board or table that is inexpensive to manufacture.

DISCLOSURE OF INVENTION

A folding table, in accordance with the present invention, comprises a table top and first and second pairs of legs connected to opposite ends of first and second cross rods, respectively. The legs in each pair are coplanar. Each cross rod includes an offset portion formed intermediate opposite ends thereof. The offset portion lies in a plane offset with respect to the associated legs. Each first and second pair of legs is pivotally connected to an underside of the table at spaced locations from each other. The table is set up by pivoting the first and second leg pairs away from the table until the offset portions flushly contact the table underside. To collapse the table, the legs are pivoted into flush contact with the table underside with the offset portion disposed in a plane angularly offset from the underside. The offset portion defines with the table underside an opening inclined away from the table underside so as to be engageable with a mounting hook and the like to store the table on a wall between periods of use.

Each pair of legs and the associated cross rod is preferably U-shaped in configuration with the plane established by the legs forming an acute angle with the plane of the associated offset portion. The first and second leg pairs, in the support position, are thus respectively inclined away from associated ends of the table. Each leg pair is preferably pivotally secured to the table underside by journalling ends of the associated cross rod in brackets.

Each offset portion preferably establishes with the table underside a triangular shaped opening having a base defined by the underside and an apex established by joining sections of the offset portion. Thus, the triangular openings are conducive to mounting either end of the table to a hook attached to a wall by passing the hook through the opening.

In accordance with another aspect of the invention, the first and second leg pairs as well as mounting brackets can be sold in kit form for attachment by the user to an ironing board or like support structure.

Additional objects, advantages and novel features of the invention will be set forth in detail in part in the description which follows and in part will become apparent to those skilled in the art upon examination of the drawing, or may be learned by practice of the invention. The objects and advantages of the invention may be realized and obtained by means of the instrumentalities and combinations particularly pointed out in the appended claims.

BEST MODE FOR CARRYING OUT THE INVENTION

Figure 1:
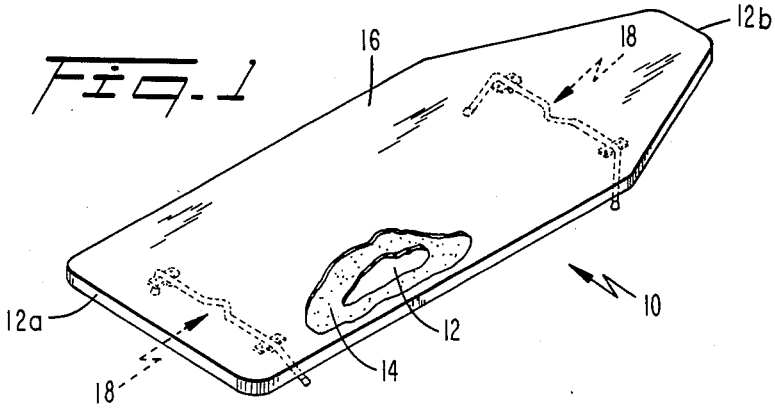
FIG. 1 is a perspective view of a portable ironing board in accordance with the present invention with pivotal legs in an extended position.
Figure 2:
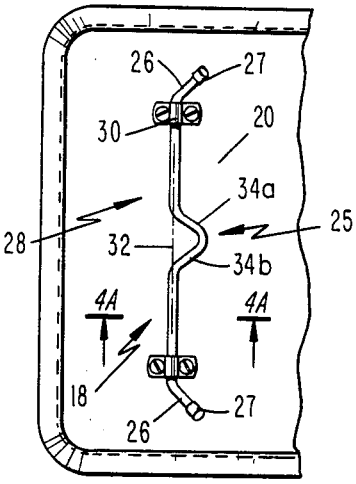
FIG. 2 is a partial, bottom plan view of a first pair of legs in the extended position.

Referring to FIG. 1, collapsible ironing board 10 of the invention comprises a rigid top board 12 of conventional shape, having a flat upper surface covered with a layer of foam 14 and a fire retardant fitted sheet 16 as is well known. First and second sets of legs 18 of identical construction are pivotally secured to underside 20 of board 12 at opposite ends thereof. Each leg set 18 can pivot between the extended or setup position of FIGS. 1, 2 and 4A and the collapsed position of FIGS. 3, 4B, 5 and 6. In the collapsed position, board 10 can be suspended from a wall 22 (see FIG. 6) by means of a hook 24 engaging an offset portion 25 uniquely formed in each leg set as discussed below. Offset portions 25 cooperate with underside 20 to automatically retain each leg set in a predetermined extended position to stably support board 12 during use.

Each leg set 18, preferably made of a heavy wire or metal rod bent into a U-shaped configuration (see, e.g., FIG. 2) includes a pair of inclined coplanar legs 26 (provided with rubber feet 27 to prevent slippage) respectively formed at opposite ends of a cross rod 28. Rods 28 extend perpendicular to the longitudinal axis of board 12 and are mounted in flush contact with underside 20 by journaling its ends in brackets or pivotal mounts 30. Each rod 28 is rotatable about longitudinal axis 32 thereof to pivot legs 26 between the extended and collapsed positions.

Figure 6:
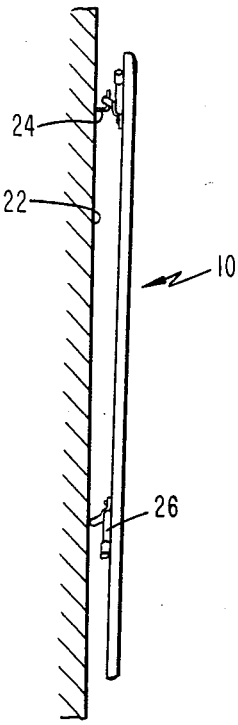
FIG. 6 is a side elevational view of the collapsed ironing board mounted for storage on a wall.

Each offset portion 25 is formed by bending a central part of rod 28 to establish a pair of coplanar inclined sections **34*a* and 34*b*. As best shown in FIGS. 4B and 6, the sections 34*a*, 34*b* lie in a plane A that is offset (by an acute angle A1) from a plane B formed by legs 26**.

Figure 4A:
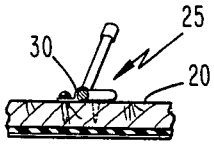
FIG. 4A is a sectional view taken along the line 4A—4A of FIG. 2.
Figure 4B:
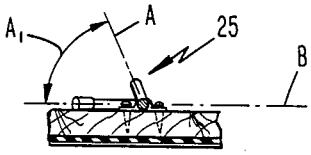
FIG. 4B is a sectional view taken along the line 4B—4B.

By forming offset sections **34*a*, 34*b* at an acute angle A1 (preferably 45°–75°) to legs 26, the legs can simply be pivoted downward away from their associated ends 12*a*, 12*b* of board 12 and be maintained in the extended position shown in FIGS. 1 and 4A (i.e., downwardly inclined towards each other) by flush contact of offset portions 25 with underside 20. In this extended position, ironing board 10 can be positioned on a support surface, such as a table (not shown). Any weight applied to board 10 is transmitted to the support surface through offset portions 25 and legs 26**. By forming angle A1 as a relatively large acute angle (e.g., 60°) torsional stress acting between the offset portion and legs is kept to a minimum.

Figure 3:
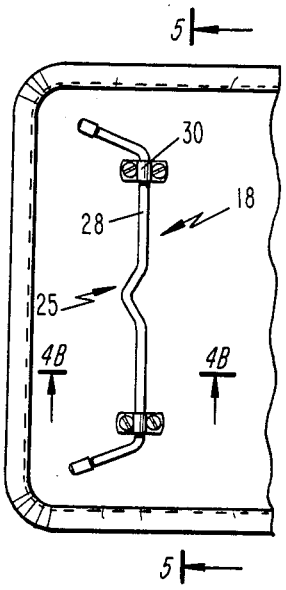
FIG. 3 is a partial, bottom plan view of the first pair of legs in the collapsed position.
Figure 5:
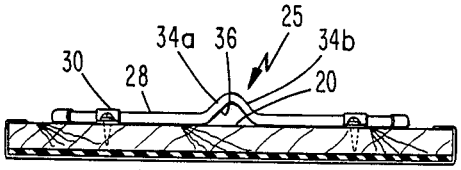
FIG. 5 is a sectional view taken along the line 5—5 of FIG. 3.

By pivoting legs 26 into flush engagement with underside 20 into the collapsed or foldup position (i.e., after ironing) shown in FIGS. 3, 5 and 6, offset portions 25 are respectively inclined towards ends **12*a*, 12*b* of board 12. Since offset portion defines with underside 20 a triangular shaped opening 36, either end of board 10 can be suspended from wall 22 by passing hook 24 through the opening, as best shown in FIG. 6**.

The foregoing description of the preferred embodiment of the invention has been presented for purposes of illustration and description. It is not intended to be exhaustive or to limit the invention to the precise form disclosed, and obviously many modifications and variations are possible in light of the above teaching. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

We claim:

1. A folding table, comprising:

(a) a table top;

(b) a first pair of coplanar legs connected respectively to opposite ends of a first cross rod and a second pair of coplanar legs connected respectively to opposite ends of a second cross rod, each first and second cross rod including an offset or crook portion formed intermediate opposite ends thereof, each offset portion lying in a plane offset with respect to the associated pair of legs; and (c) means for pivotally connecting the first and second pairs of legs to an underside of the table at spaced locations from each other, said connecting means enabling each first and second pair of legs to pivot (1) away from the table into a predetermined setup position established by flush contact of the offset portion with the table underside so that the legs support the table above a support surface, and (2) towards the table into a foldup position wherein the legs are in flush contact with the table underside and extend towards the associated end of the table and the offset portion is disposed in a plane offset from the plane of the legs and the underside each offset portion thereby defining with the table underside an opening inclined away from the table in the foldup position, said opening being engageable with a mounting hook to store the table on a wall between periods of use whereby support forces generated by the weight of the table acting upon the mounting hook through the offset portion supported thereby tends to urge the legs into tight contact with the table underside.

2. The folding table of claim 1, wherein each pair of legs and associated cross rod is U-shaped in configuration, the plane established by each pair of legs forming an acute angle with the plane of the associated offset portion so that the first and second pairs of legs, in the setup position, are respectively inclined away from associated ends of the table.

3. The table of claim 2, wherein each cross rod extends transverse to the longitudinal axis of the table.

4. The table of claim 3, wherein each offset portion establishes with the table underside a triangular shaped opening having a base defined by the underside and an apex established by adjoining sections of the offset portion.

5. The table of claim 1, wherein said connecting means includes a pair of pivot mounts attached to the table underside, opposite ends of each cross rod being journalled in said pivot mounts.

6. The folding table of claim 1, wherein the entire length of each leg rests against the table underside in the foldup position.

7. The table of claim 6, wherein said acute angle is approximately 60 degrees.

8. The table of claim 1, wherein said offset portion is disposed in a plane offset at an acute angle from the plane of the legs and the underside of the table extending towards the associated end to define an opening inclined away from the table and towards the associated end.

9. An ironing board, comprising:

(a) a top member having a generally flat, elongated upper surface covered with a fire retardant material;

(b) a first pair of coplanar legs connected respectively to opposite ends of a first cross rod and a second pair of coplanar legs connected respectively to opposite ends of a second cross rod, each cross rod including an offset or crook portion formed intermediate the opposite ends, each offset portion lying in a plane offset with respect to the associated pair of legs; and (c) means for pivotally connecting the first and second pairs of legs to an underside of the table with each cross rod extending transverse relative to the longitudinal axis of top member at spaced locations from each other, said connecting means enabling each first and second pair of legs to pivot (1) away from the table into a predetermined setup position established by flush contact of the offset portions with the top underside so that the legs support the table above a support surface, and (2) towards the top into a foldup position wherein the legs are in flush contact with the top underside and extend towards the associated end of the table and the offset portions are disposed in planes angularly offset from the underside, each offset portion defining with the top underside an opening inclined away from the table in the foldup position so as to be engageable with a mounting hook and the like to store the table on a wall between periods of use.

10. The ironing board of claim 9, wherein each offset portion defines with the top underside a triangularly shaped opening inclined away from the table in the direction of an associated end of the top.

11. A table leg and leg locking kit for use in supporting a table in an elevated position above a support surface and for storing the table in a foldup position between periods of use, comprising:

(a) a first pair of legs formed coplanar with each other and connected respectively to opposite ends of a first cross rod formed with an offset portion intermediate opposite ends thereof, said offset portion lying in a plane offset with respect to the first pair of legs;

(b) a second pair of legs formed coplanar with each other and connected respectively to opposite ends of a second cross rod formed with an offset portion intermediate opposite ends thereof, and offset portion lying in a plane offset with respect to the second pair of legs; and (c) a first pair of brackets and a second pair of brackets and screw means for fixing each pair of brackets to the table underside so that the brackets in each pair respectively establish with the table underside receiving holes that are coplanar with each other to receive and journal opposited ends of each cross rod in the brackets, enabling each first and second pair of legs to pivot (1) away from the table into a predetermined setup position established by flush contact of the offset portion with the table underside so that the legs extend to support the table above a support surface, and (2) towards the table into a foldup position wherein the legs are in flush contact with the table underside and extend towards the associated end of the table and the offset portion is disposed in a plane angularly offset from the underside, said offset portion having a pair of inclined rod sections defining with the table underside a generally triangular shaped opening inclined away from the table and towards the associated end of the table in the foldup position, an apex of said triangular opening projecting outward from the table underside so as to be engageable with and to center a mounting hook against the apex to store the table on a wall between periods of use.

* * * * *